US005715565A

United States Patent [19]

Kern

[11] Patent Number: 5,715,565

[45] Date of Patent: Feb. 10, 1998

[54] DEVICE FOR CLEANING GROOVED SURFACES SUCH AS ESCALATORS OR GANGWAYS

[76] Inventor: Torsten Kern, Bahnhofstrasse 1, D-72511 Bingen, Germany

[21] Appl. No.: 788,652

[22] Filed: Jan. 24, 1997

[51] Int. Cl.[6] ..... A47L 7/02

[52] U.S. Cl. ..... 15/302; 15/308; 15/322

[58] Field of Search ..... 15/302, 321, 322, 15/308

[56] References Cited

U.S. PATENT DOCUMENTS

| | | | |
|---|---|---|---|
| 3,273,193 | 9/1966 | Soderholm et al. | 15/320 |
| 3,559,230 | 2/1971 | Ogle | 15/302 |
| 3,584,329 | 6/1971 | Cravits . | |
| 3,869,749 | 3/1975 | London et al. | 15/302 |
| 4,161,802 | 7/1979 | Knight et al. | 15/322 X |
| 4,709,441 | 12/1987 | Center | 15/301 |

FOREIGN PATENT DOCUMENTS

| | | |
|---|---|---|
| 9106190.3 | 5/1991 | Germany . |
| 9403085.5 | 2/1994 | Germany . |

OTHER PUBLICATIONS

"Automation" Jul., 1973.

*Primary Examiner*—Chris K. Moore
*Attorney, Agent, or Firm*—Collard & Roe, P.C.

[57] ABSTRACT

A device for cleaning grooved surfaces, such as moving escalators or gangways, comprising a rotatingly driven roll brush arranged in a casing, a spraying device for spraying cleaning liquid, a suction device for removing loosened dirt particles from the rotation space of the roll brush and a plurality of comb-like devices arranged in front of and behind the roll brush in the direction of movement of the escalator or gangway. The comb-like devices engage the spaces between the grooves of the escalator or gangway and, in combination with the casing, seal the rotation space of the roll brush from the outside. The spraying device wets the grooved surface, the roll brush loosens dirt on the grooved surface and collects the loosened dirt, and the suction device removes the cleaning liquid and loosened dirt from the roll brush, thus accomplishing efficient cleaning of the grooved surface.

6 Claims, 3 Drawing Sheets

DEVICE FOR CLEANING GROOVED SURFACES SUCH AS ESCALATORS OR GANGWAYS

BACKGROUND OF THE INVENTION

1. Field of the Invention

The invention relates to a device for cleaning grooved surfaces such as escalators or gangways, comprised of a rotatingly-driven roll brush arranged in a housing, a spraying device for cleaning liquid, and a suction device for removing the loosened dirt particles.

2. The Prior Art

Escalators and gangways having grooved surfaces are used both in enclosed spaces such as department stores and airports, and also outdoors, such as in subway stairways. These outdoor escalators are especially subject to heavy soiling and must be cleaned regularly. Automatic cleaning devices have already been proposed for such cleaning. The presently-used cleaning devices use dry rotating brushes. Because this type of cleaning requires a relatively high contact pressure of the brush to obtain a satisfactory cleaning result, the rotating brushes of the known equipment are subject to heavy wear. Furthermore, such dry cleaning yields poor cleaning results because some types of dirt can be loosened and removed only with suitable liquids.

A wet cleaning device of the type specified above is also shown in DE-GM 94 03 085. Two roll brushes are arranged side by side and are wetted with a spraying device. A suction device is located behind the brushes and removes the dirt particles already loosened from the stairway step or plate. One drawback with the known device is that the suction device is inefficient because it sucks up not only the loosened dirt particles, but also large amounts of air from the surrounding casing and outside. Therefore, it impossible to suck dirt from the grooves with satisfactory results. Furthermore, the suction device is spaced a large distance away from the roll brush, so that cleaning liquid penetrates between the individual steps or into the gaps between the stairway step and the lateral walls before the suction device can remove it.

SUMMARY OF THE INVENTION

It is therefore an object of the present invention to overcome the drawbacks of the prior art and to avoid the aforementioned problems. The invention is a device for cleaning grooved surfaces, such as bridge escalators or gangways that move in a defined direction, comprising a rotatingly driven roll brush arranged in a casing, a spraying device for spraying cleaning liquid, a suction device for removing loosened dirt particles from the rotation space of the roll brush, and a plurality of comb-like devices arranged in front of and behind the roll brush in the direction of movement of the escalator or gangway. The comb-like devices engage the spaces between the grooves of the escalator or gangway and, in combination with the casing, seal the rotation space of the roll brush from the outside. The spraying device wets the grooved surface, the roll brush loosens dirt on the grooved surface and collects the loosened dirt, and the suction device removes the cleaning liquid and loosened dirt from the roll brush, thus accomplishing efficient cleaning of the grooved surface. Therefore, the present invention sucks loosened dirt directly from the roll brush. Because the rotation space of the brush is sealed against the outside, a vacuum is generated in the rotation space of the brush. Therefore, all of the cleaning liquid and the loosened dirt is seized and removed by the suction device. A constant suction is produced between the teeth of the combs and the walls of the grooves. Therefore, cleaning liquid or dirt cannot penetrate the escalator drive or gangway drive and damage the drive.

Preferably, the comb-like device arranged in front of the roll brush has teeth that only partially fill the grooves, so as not to interfere with the transport of the dirt particles into the rotation space of the roll brush. The dirt particles can also be transported to the roll brush by placing a precleaning roll brush upstream of the roll brush in the direction of movement of the escalator or running gangway, which is wetted with cleaning liquid by the spraying device. Therefore, before passing the first chamber device, the dirt particles are already dissolved in the cleaning liquid and can pass through the comb-like device to be received in the rotation space of the roll brush and removed by the suction device in an even simpler way. The pre-cleaning brush enhances cleaning result as well. Furthermore, the roll brush can have a spiral-shaped bristle facing, which transports the dirt to a point on the rotation space of the brush, where the dissolved dirt particles are then removed by the suction device.

In order to prevent destruction of the cleaning device due to lateral displacement of the stairway steps or plates, a guiding device that engages a groove of the steps or plates of the escalator or moving gangway can be installed on at least one side of the device. The guiding device engages a step or plate directly in front of or behind a step board of the escalator or gangway. The step boards have a comb-like structure, so that the steps or plates leave from or drive beneath the step boards in a defined lateral position. By placing the guiding device directly adjacent to a step board, the cleaning device maintains a defined lateral position. This ensures that the comb-like devices of the cleaner can pass unobstructed between the individual step surface segments of the escalator or gangway.

Preferably, the bristles of the precleaning brush and the roll brush touch the surrounding casing. In this way, dirt particles adhering to the bristles and the casing are stripped off and the dirt is prevented from collecting between the brush and the casing or from falling back onto the brush. Instead, the dirt particles are uniformly fed to the roll brush. Furthermore, by resting against the casing, the brush can better counteract the pressure generated by the surface to be cleaned. The brush body is not reflected even by high pressure forces. Thus, brushes with low lengthwise stability will always rest on the surface to be cleaned. The present invention thus enables the use of brushes with flexible brush bodies, or with a bristle arrangement not leading to straight-line brush stroke contours.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
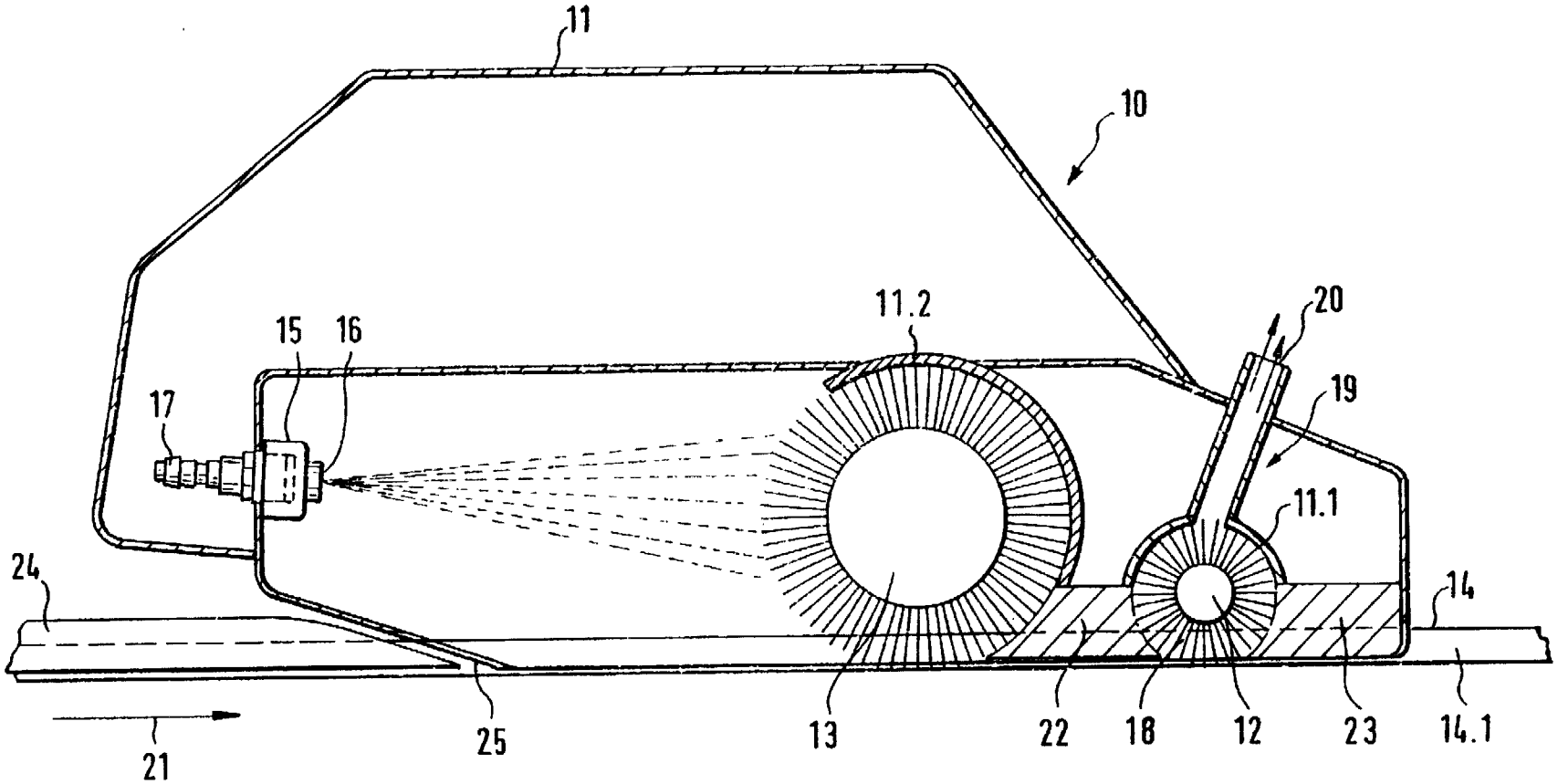
FIG. 1 is a longitudinal sectional view of a cleaning device placed on a stairway step.

Referring now in detail to the drawings and, in particular, FIG. 1, there is shown a cleaning device 10, which can be coupled to a cleaning cart. Device 10 has a casing 11, which opens downward. A roll brush 12 and a roll-shaped precleaning brush 13 are arranged in the interior of casing 11. Brushes 12 and 13 are rotatingly driven. Brushes 12 and 13 and device 10 rest on a grooved step 14 of an escalator, preferably either directly ahead of or directly behind a step board 24.

A spraying device 15 is also arranged in casing 11. Spraying device 15 wets precleaning brush 13 with cleaning liquid via nozzle 16. The cleaning liquid is fed to spraying device 15 via connection 17. A suction device 19 having a short suction pipe 20 engages rotation space 18 of roll brush 12. Two comb-like devices 22 and 23 are arranged in front of and behind rotation space 18 of roll brush 12 in the direction of movement 21 of stairway steps 14.

Figure 2:
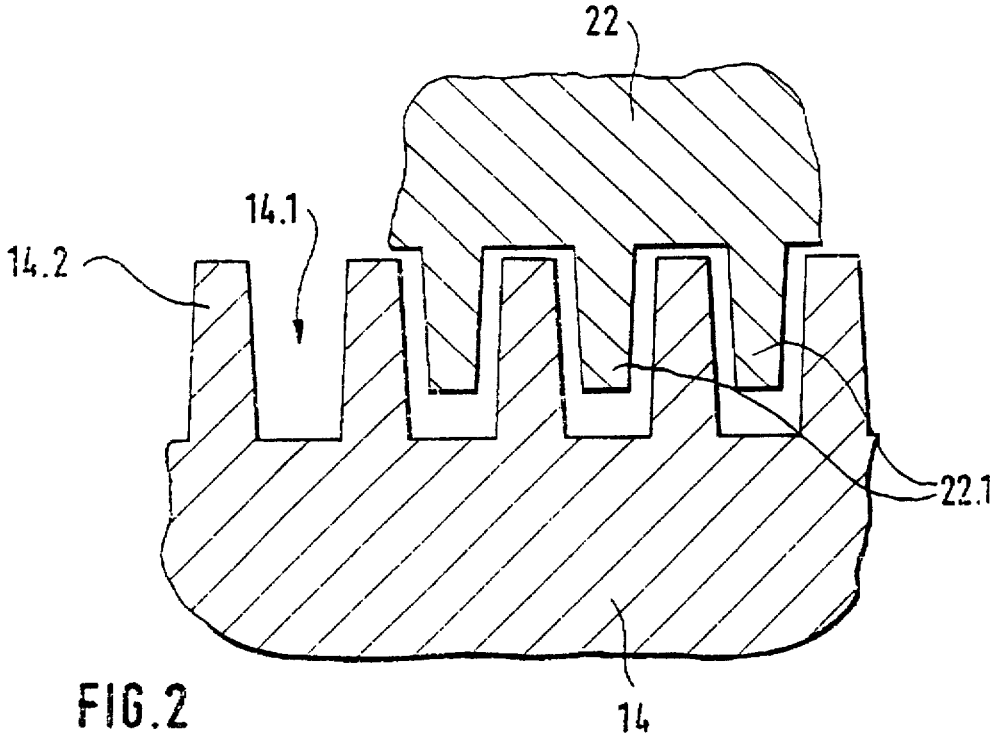
FIG. 2 is a partial cross-sectional view of the comb-like device of the cleaning device shown in FIG. 1.
Figure 3:
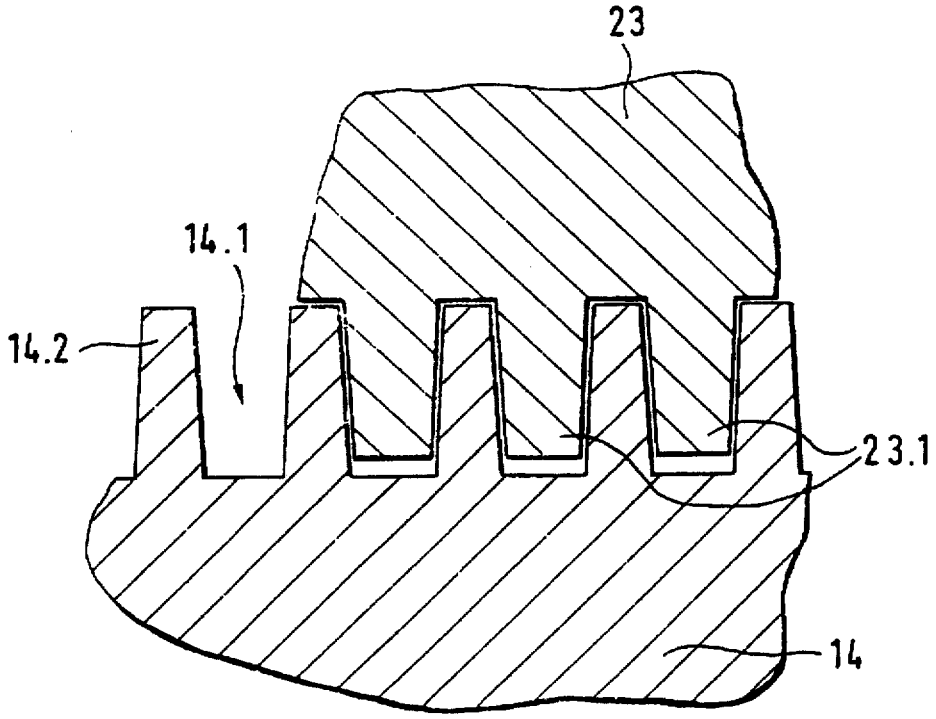
FIG. 3 is a partial cross-sectional view of the second comb-like device of the cleaning device shown in FIG. 1.

Comb-like devices 22 and 23, jointly with the casing part 11.1, seal rotation space 18 against the outside. This increases the effect of suction device 19. Comb-like device 22 has teeth 22.1 as shown in FIG. 2, which only partially fill gaps 14.1 between grooves 14.2 of stairway step 14. Therefore, comb-like device 22 does not interfere with the transport of dirt particles into rotation space 18 of roll brush 12. Teeth 23.1 of comb-like structure 23 behind roll brush 12 (seen in FIG. 3) nearly fills the gaps 14.1 between grooves 14.2 of stairway step 14.

During cleaning, the stairway steps passing below cleaning device 10 in the direction of arrow 21 are first slightly wetted by precleaning brush 13, which has been wetted with cleaning liquid, and transported through comb-like device 22 into rotation space 18 of roll brush 12. Dirt on the steps is seized by roll brush 12, and transported by the spiral-shaped bristle facing of roll brush 12 to a point of rotation space 18, where suction pipe 20 of suction device 19 engages and aspirates. Second comb-like device 23 not only increases the efficiency of suction device 19, but also prevents dirty water from flowing out of cleaning device 10 in the direction of movement 21 of stairway steps 14. All cleaning liquid applied to the stairway steps is removed with the dirt by suction device 19. In addition, the bristles of brushes 12 and 13 slide along casing walls 11.1 and 11.2, stripping off dirt particles caught on the bristles. Therefore, continuous self-cleaning of the brushes and of the casing takes place.

The device of the present invention can be set up and run without supervision at the top or bottom end of an escalator or a moving gangway to automatically clean the steps or plates. The width of device 10 is preferably greater than half of the width of a moving gangway or escalator. This way, an escalator or a moving gangway can be completely cleaned with two cleaning runs. One side of casing 11 is designed so that the cleaner can drive close to the lateral edge of the stairway steps or plates.

Figure 4:
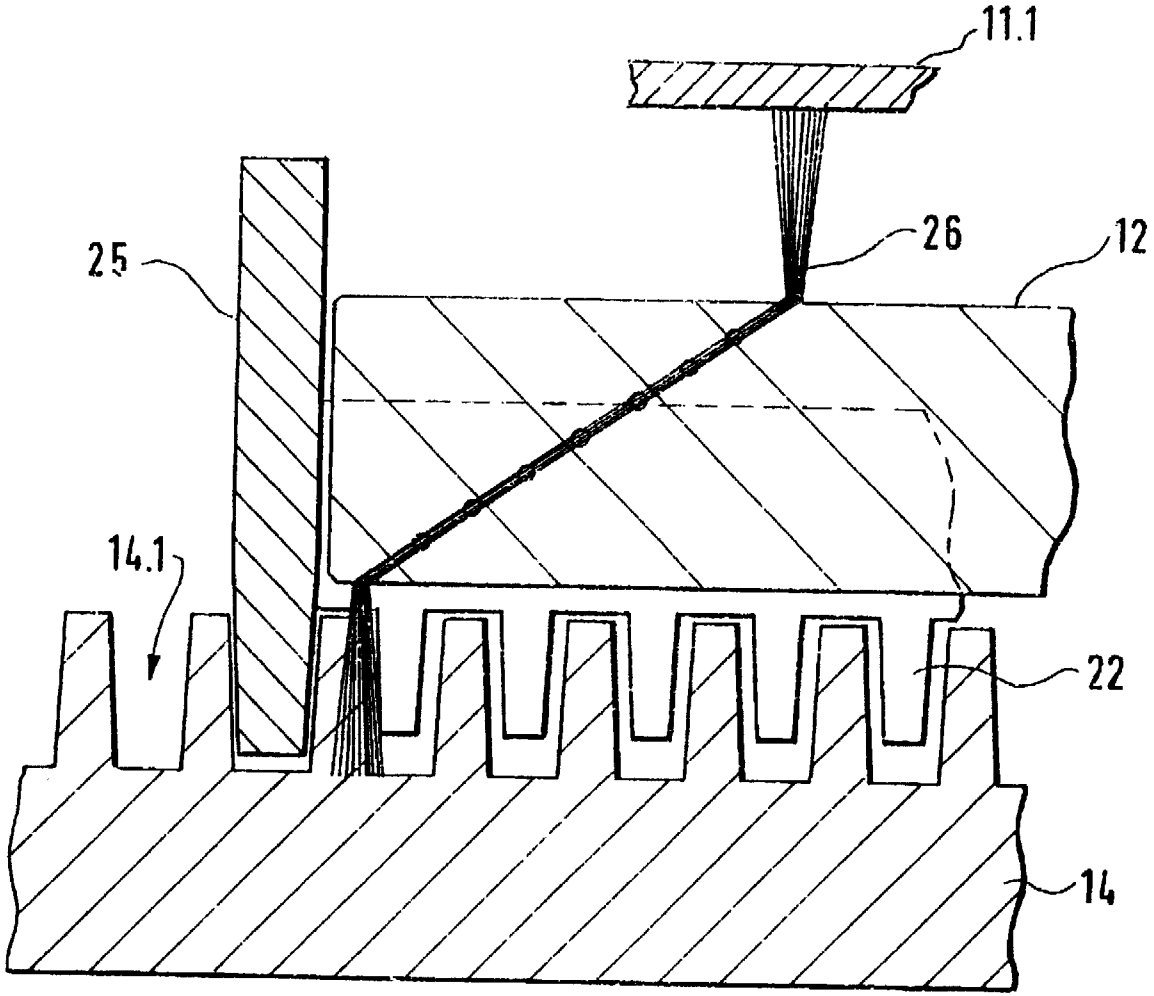
FIG. 4 is a partial cross-sectional view of the cleaning device with the guiding device attached.

FIG. 4 shows an alternative embodiment of the invention, wherein the bristles 26 of brush 12 are spiral-shaped so that dirt from the cleaning space can be transported to a point on the rotation space of the brush where it can be easily removed by the suction device.

FIG. 4 also shows a guiding device 25, which may be attached on one side of the cleaning device for keeping the cleaning device in a defined, lateral position. Guiding device 25 engages a groove 14.1 of stairway step 14 and keeps the cleaning device in a defined lateral position as it cleans the steps. Guiding device 25 is preferably arranged directly ahead of or behind a step board of the escalator or gangway. This way, guiding device 25 ensures that comb-like device 22 can pass unobstructed through the grooves 14.1 on stairway step 14.

Accordingly, while only several embodiments of the present invention have been shown and described, it is obvious that many changes and modifications may be made thereunto without departing from the spirit and scope of the invention according to the appended claims.

What is claimed is:

1. A device for cleaning grooved surfaces, such as moving escalators or gangways, said grooved surfaces having spaces between the grooves where dirt collects, comprising:

a casing;

a rotatingly driven roll brush arranged in said casing, said roll brush having bristles and defining a rotation space;

a spraying device arranged in said casing for spraying cleaning liquid;

a suction device arranged in close proximity to said roll brush for removing loosened dirt particles from the rotation space of the roll brush; and a plurality of comb-like devices arranged in front of and behind the roll brush in the direction of movement of the escalator or gangway, said comb-like devices engaging the spaces between the grooves in the escalator or gangway and, in combination with the casing, sealing the rotation space of the roll brush from the outside, wherein the spraying device wets the grooved surface, the roll brush loosens dirt on the grooved surface and collects the loosened dirt, and the suction device removes the cleaning liquid and loosened dirt from the roll brush.

2. The device according to claim 1, wherein the comb-like devices have teeth that partially fill the spaces between the grooves of the escalator, so that dirt can easily be collected by the roll brush.

3. The device according to claim 1, further comprising a precleaning roll brush arranged upstream of the roll brush in the direction of movement of the escalator or gangway, wherein said precleaning roll brush has bristles and is wetted with cleaning liquid by the spraying device.

4. The device according to claim 3, wherein the bristles of the precleaning brush and the roll brush are in contact with the casing and comb-like devices.

5. The device according to claim 1, wherein the bristles of the roll brush are spiral shaped so that dirt and residual cleaning liquid are transported to a point on the rotation space of the brush for removal by the suction device.

6. The device according to claim 1, further comprising at least one guiding device for engaging a groove on the escalator or gangway to be cleaned, said guiding device arranged on one side of the cleaning device, wherein the escalator or gangway has a step board, wherein the guiding device engages the groove directly adjacent to the step board of the escalator or gangway, and wherein the guiding device ensures a defined lateral position of the cleaning device.

* * * * *